United States Patent [19]

Clapp

[11] Patent Number: 4,551,024

[45] Date of Patent: Nov. 5, 1985

[54] MIXING APPARATUS FOR CEMENTITIOUS MATERIALS

[76] Inventor: Thomas R. Clapp, P.O. Box 2529, Midland, Mich. 48640

[21] Appl. No.: 257,162

[22] Filed: Apr. 24, 1981

[51] Int. Cl.[4] ..... B28C 5/14

[52] U.S. Cl. ..... 366/40; 366/50; 366/64; 366/347

[58] Field of Search ..... 366/10, 13, 35, 40, 366/99, 168, 197, 347, 64, 68, 50

[56] References Cited

U.S. PATENT DOCUMENTS

| | | | |
|---|---|---|---|
| 2,159,205 | 5/1939 | Clemens | 366/64 |
| 2,709,075 | 5/1955 | August | 366/40 X |
| 3,199,145 | 8/1965 | Tiemersma | 366/79 |
| 3,227,424 | 1/1966 | Cunningham | 366/194 |
| 3,310,293 | 3/1967 | Zimmerman | 366/6 |
| 3,339,898 | 9/1967 | Futty et al. | 366/6 |
| 3,348,820 | 10/1967 | Wilkinson et al. | 366/64 |
| 3,459,409 | 8/1969 | Goldberger | 366/40 |
| 3,863,849 | 2/1975 | Kugle et al. | 241/76 X |
| 3,901,483 | 8/1975 | Lasar | 366/93 |
| 4,205,919 | 6/1980 | Attwell | 366/64 X |

*Primary Examiner*—Philip R. Coe

*Assistant Examiner*—Frankie L. Stinson

*Attorney, Agent, or Firm*—Haight, Hofeldt, Davis & Jambor

[57] ABSTRACT

An apparatus for mixing a cementitious material, such as those quick-setting cementitious materials utilizing a volatile liquid, has a solid frame as the top of a mixing chamber. An inlet end of the solid frame is pivotably mounted on a vehicle. An auger or mixing screw is mounted in the frame, the auger being removable from the frame due to the mounting of one bearing in a removable plate member and the provision of a releasable flexible coupling between this end of the auger shaft and the drive motor. A low pressure gas may be inserted into the housing of the other bearing to prevent seepage of liquid or fumes into that bearing. A removable elastomeric trough forms the bottom of the mixing chamber and contains a discharge opening. A substantially dry material is inserted into the mixing chamber through an inlet hopper and a liquid injection arrangement introduces a liquid into the mixing chamber. The liquid injection arrangement extends along a length of the auger and is spaced from the inlet hopper, so that the substantially dry material forms a plug to prevent the liquid or fumes from backing up the inlet hopper.

11 Claims, 14 Drawing Figures

7
7

63
61
35
65
39
46
41
47
33
51
53
55
44
115
123
121
119
125
105
103
99
101
107
91
117

MIXING APPARATUS FOR CEMENTITIOUS MATERIALS

BACKGROUND OF THE INVENTION

1. Field of the Invention

This invention relates generally to an apparatus for mixing cementitious materials, and more specifically, this invention relates to an auger type of mixing apparatus for quick-setting cementitious materials employing a volatile liquid.

2. Description of the Prior Art

Mixing apparatuses employing an elongated chute with an enclosed mixing auger or screw are known in the art. For example, one such apparatus is illustrated in U.S. Pat. No. 3,339,898—Futty et al., entitled "Mixing Method and Mixing Trough Construction", issued on Sept. 5, 1967 to Irl Daffin Associates, Incorporated.

IN structures of this type, the mixing auger is permanently mounted in the mixing trough. An elastomeric bottom member is positively secured to a frame. Access to the mixing chamber or trough is achieved through a door or doors on top of the apparatus.

In operation, the materials to be mixed are jointly inserted at an inlet, conveyed through the apparatus by the mixing auger and forced out the discharge opening at the other end of the mixing chamber.

One of the major drawbacks of a mixing apparatus of this type is that it is difficult to clean the inside of the mixing chamber. The limited access through the door or doors at the top of the chamber is not sufficient for complete cleaning of the auger mechanism and the inner chamber walls. While this problem is not insurmountable when utilized for conventional concrete, since the concrete does not completely harden for a long period of time and may be washed out with water, the problem becomes much more severe when the apparatus is utilized for a quick-setting cementitious material, such as that based upon the volatile liquid methyl methacrylate.

Another disadvantage of an apparatus of this type, when utilized for a quick-setting material employing a volatile liquid, is the lack of a complete seal. Thus, gaseous fumes released from the liquid, or the liquid itself, can escape from the mixing chamber. As such a liquid and its released gaseous fumes may be hazardous, prior art mixing apparatuses cannot be safely used.

Since differing volatile liquids might be involved, an elastomeric trough bottom suitable for one material might react with another material and be completely unsuitable. Therefore, even if a prior art mixing apparatus could be modified to permit its utilization with a quick-setting cementitious material, the elastomeric material utilized may render it unsuitable for a particular quick-setting cementitious material.

Accordingly, it would be desirable to provide a mixing apparatus for a cementitious material employing a volatile liquid that would not permit the escape of the volatile liquid or its vaporized fumes from the mixing chamber. Also, such an apparatus should be readily adaptable for various types of cementitious materials based on different volatile liquids or active components. Further, the apparatus should be constructed so that it may be easily and quickly cleaned after the mixing operation has ceased.

SUMMARY OF THE INVENTION

With the present invention, a mixing apparatus for cementitious materials employing volatile liquids is provided. This mixing apparatus is sealed to prevent the volatile liquid or any associated fumes from escaping from the mixing chamber, and the mixing chamber may be readily and easily adaptable to various types of materials. In addition, the mixing chamber may be quickly and easily disassembled for cleaning, transportation or replacement of its elastomeric trough member.

To achieve these desired results, a solid upper frame is an inverted substantially U-shaped member. At one end of the frame, an inlet hopper is mounted to receive substantially dry material and pass it through a corresponding opening in the top of the frame. This end of the frame may be pivotably mounted to a vehicle, such as a truck that is adapted to transport the materials to be mixed.

An auger or mixing screw is rotatably mounted in the frame. The end of the auger shaft adjacent the inlet hopper is supported by a bearing that is mounted in a housing. Since this apparatus is to be utilized for mixing a cementitious material including a volatile liquid, with the liquid, any fumes that are produced by vaporization and the mixture creating potential hazards for both the bearing and any individuals in the vicinity, it is desirable to place a relatively inert gas, such as air or nitrogen, in the bearing housing under a pressure slightly above the ambient pressure. This precludes seepage of the liquid, mixture or fumes into the bearing housing.

The bearing for the auger shaft at the discharge end is located in a plate member that is removably mounted on the frame. A drive motor for the auger is also mounted on the frame, and the drive shaft of the motor is connected to the end of the auger shaft by a releasable flexible coupling. By releasing this flexible coupling and disconnecting the mounting plate for the discharge end bearing, the auger may be removed from the frame for cleaning or shipping.

To complete the formation of a mixing chamber about the auger, an elastomeric trough is utilized as the bottom member. This elastomeric trough is removably mounted on the frame for the purposes of cleaning and shipping the trough itself, as well as providing access for cleaning and removing the auger. Mating horizontal flanges are formed on the top edges of the elastomeric trough and the bottom edges of the frame. These flanges may be joined by suitable connecting means, such as slotted pins and wedges, to permit quick and easy attachment and removal. A discharge opening is formed in the bottom of the elastomeric trough, and a suitable discharge chute may be provided.

A liquid for mixing with the substantially dry material inserted through the inlet hopper is sprayed into the mixing chamber in any suitable fashion, such as by a pair of spray elements extending along the auger. These spray elements are mounted on the inside surface of the top of the frame. These spray elements are mounted sufficiently far from the inlet hopper so that the substantially dry material provides a plug that prevents the liquid and any fumes from backing up out the inlet hopper. By extending the spray elements along the auger, the liquid tends to wash the auger for lubrication and promote better mixing.

Injection of the liquid through the spray elements is determined by a pair of valves. These valves may be suitably activatable by an appropriate control arrangement, such as electrically energized solenoid valves or pneumatically actuated valves. By actuating the valves to introduce liquid simultaneously with the introduction of the substantially dry material initial lubrication of the auger is produced. Termination of the insertion of the liquid and dry material at the same time results in the last portion of the mixture leaving the discharge opening being relatively dry to absorb all of the liquid and thus reduce the chance of any of the volatile liquid reaching the air in an uncombined form.

In order to ensure that the mixing chamber is completely sealed, it is desirable to place a silicone sealer, or another sealer compatible with the materials, around all of the joints. This ensures, along with the other provisions described, that hazardous fumes are not released from the mixing chamber.

These and other objects, advantages and features of this invention will hereinafter appear, and for puposes of illustration, but not of limitation, an exemplary embodiment of the subject invention is shown in the appended drawing.

DETAILED DESCRIPTION OF THE PREFERRED EMBODIMENT

Figure 1:
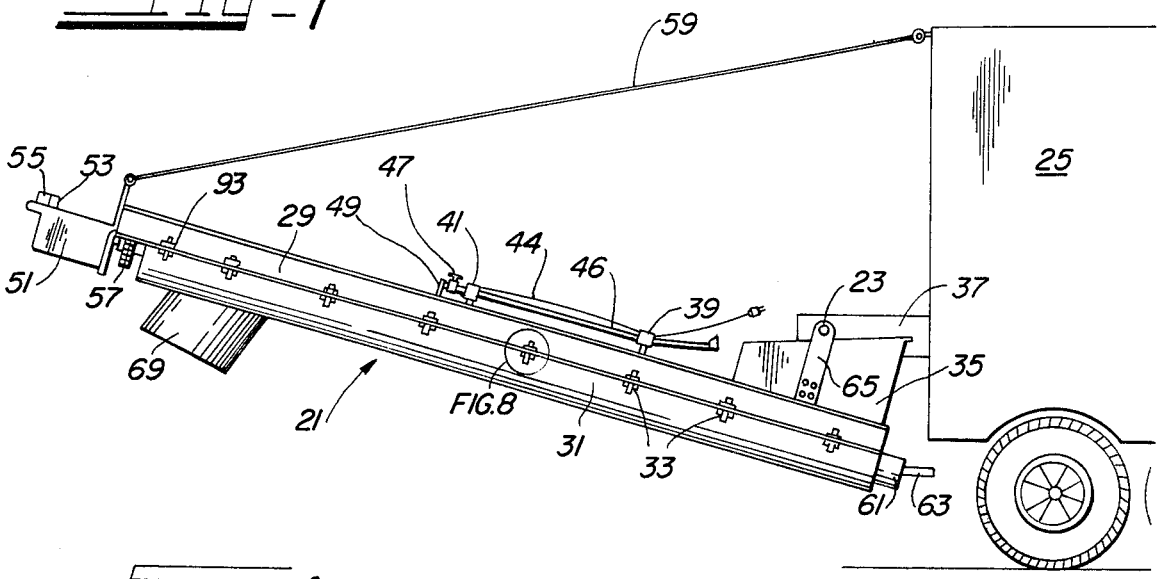
FIG. 1 is a side perspective view of a mixing apparatus constructed in accordance with the present invention and mounted on a vehicle.

A mixing apparatus 21 is illustrated in FIG. 1 as being pivotably mounted at point 23 to a vehicle 25. Vehicle 25 is adapted to transport the materials to be inserted into the mixing apparatus 21. Mixing apparatus 21 has a mixing chamber 27 (FIG. 6) that is encompassed by a top solid frame 29 and a lower elastomeric trough 31. The solid top 29 and the elastomeric trough 31 are releasably joined together by connecting members 33.

Frame 29 has an inlet hopper 35 located at an inlet end of mixing apparatus 21 for inserting substantially dry material into the mixing chamber 27. This substantially dry material is brought from vehicle 25 by any suitable conveying means, the casing 37 for which is illustrated in FIG. 1.

A liquid, which may be a volatile liquid such as methyl methacrylate, is inserted into the mixing chamber 27 at a point removed from the inlet hopper 35. This permits the substantially dry material to form a plug to block a liquid or any fumes, such as gases formed by vaporization of the liquid, from backing up the inlet hopper 35. In this way, the inlet hopper is essentially sealed to prevent the escape of all, or at least most, of any gases in the mixing chamber, without interfering with the insertion of the substantially dry material into the mixing chamber. When the liquid is methyl methacrylate, the dry material may include an appropriate initiator, such as benzoyle peroxide, although the initiator could also be inserted in liquid form.

Injection of the liquid into mixing chamber 27 is determined by a pair of valves 39 and 41. It is apparent, of course, that a single valve or more than two valves could be utilized. However, in this preferred embodiment the liquid is inserted into the mixing chamber by spraying from a pair of spray elements 43 and 45 (FIG. 3), and thus a pair of valves is most appropriate in this embodiment.

Valves 39 and 41 are any suitably controllable valves, such as solenoid actuated or pneumatically actuated valves. When a volatile liquid is employed, it might be preferable to utilize pneumatically actuated valves to preclude combustion of the volatile liquid, although with the sealed mixing chamber of this invention and suitable protection for the electrical circuits, the use of electrically energized solenoid valves is equally appropriate. In this case, the valves 39 and 41 employed in this preferred embodiment are shown as being electrically actuated through a suitable line 44.

Liquid to be injected into the mixing chamber 27 is provided through a suitable line 46, which would receive the liquid from the vehicle 25. Although not an essential element, this line is shown as being provided with a manually actuatable drain valve 47. Drain valve 47 may be employed to drain any liquid in line 46 into the mixing chamber 27 through the extension 49 of line 45.

A motor 51, shown as an hydraulic motor driven through hydraulic lines 53 and 55, is secured to frame 29. Motor 51 provides the rotational driving energy for the auger in mixing chamber 27. A releasable flexible coupling 57 is provided between the end of the motor shaft and the discharge end of the shaft of the auger. This flexibility, combined with the flexibility provided by the utilization of rubber spacers 89 in the mounting of the motor to the frame 29, serves to protect motor 51.

Mixing apparatus 21 is pivoted to a desired angle for the chute formed by frame 29 and the elastomeric trough 31. Mixing apparatus 21 is maintained in this position by a chain or cable 59 extending from the vehicle 25 to the discharge end of the apparatus.

The other end of the auger shaft (i.e., the inlet end) is supported by a bearing located in a bearing housing 61. Due to the angle of the mixing apparatus 21, liquid or mixture can work its way back into the bearing housing 61, which can create significant difficulties for this bearing. In order to preclude seepage of the liquid, mixture and associated fumes into this bearing housing, it is desirable to insert a low pressure gas into the housing. The gas utilized may be air or an inert gas such as nitrogen, and the pressure should be slightly above ambient (e.g., two p.s.i.g.).

After mixing has been completed, the mixture is passed out a discharge opening formed in the elastomeric trough 31. In this case, although not essential, a discharge chute 69 has been provided.

Figure 4:
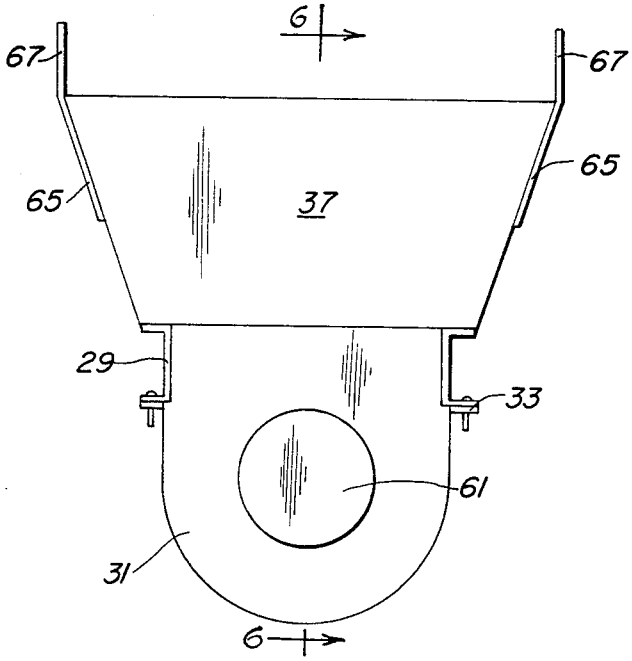
FIG. 4 is an elevational view from the end of the mixing apparatus of FIG. 2 adajacent the vehicle in FIG. 1.

From the end view of FIG. 4, it may be seen that the supporting brackets 65, by which the frame 29 is pivotably mounted, have top portions 67 that are vertically parallel. The connecting of the frame 29 to the elastomeric trough 31 by the connecting arrangements 33 may also be seen. To better explain the connecting arrangement, reference may be made to FIGS. 8 and 9.

Figure 8:
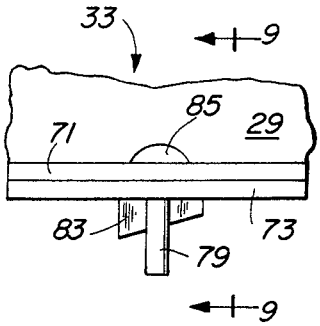
FIG. 8 is a partial, enlarged view illustrating a connecting device utilized in the mixing apparatus of FIG. 1.
Figure 9:
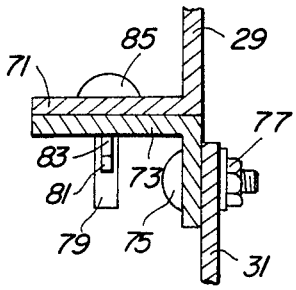
FIG. 9 is a cross-sectional view taken along line 9—9 of FIG. 8.

From FIG. 9, it may be seen that the bottom edge of frame 29 is provided with a horizontally extending flange 71. A mating flange 73 is connected to the top of elastomeric trough 31 in any suitable fashion, such as by the use of a bolt 75 and a nut 77. A pin 79 extends through a suitable opening in the flanges 71 and 73. Pin 79 has a slot 81 formed in the shaft thereof. A wedge 83 may be driven into slot 81 to secure the frame 29 and the elastomeric trough together, as shown in FIG. 8. To release the wedges 83 and permit separation of trough 31 from frame 29, the head 85 of pin 79 may be struck, such as by a hammer blow, to release wedge 83 for removal.

Figure 5:
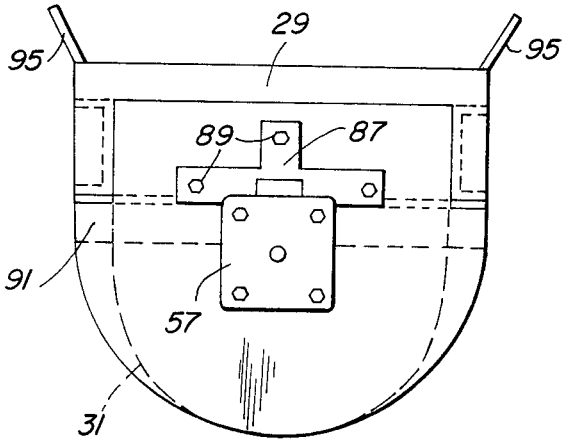
FIG. 5 is an end elevational view of the mixing apparatus of FIG. 2 from the end of the apparatus away from the vehicle in FIG. 1.
Figure 7:
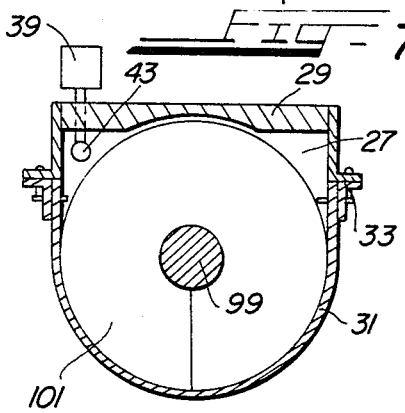
FIG. 7 is a cross-sectional view taken along line 7—7 of FIG. 6.

From the end view of FIG. 5, the mounting of motor 51 to frame 29 by means of the mounting plate 87 may be seen. As indicated above, rubber spacers 89 are utilized in this mounting to give some flexibility for the mounting of the motor to the frame. Supports 95 are provided for the hydraulic lines 53 and 55 for the hydraulic motor 51.

A mounting plate 91 for the discharge end bearing of the auger shaft may also be seen in the view of FIG. 5. Mounting plate 91 is releasable secured to the frame 29, such as by a slotted pin and wedge connector 93 (FIG. 1) of the same type as the connectors 33 utilized to secure the elastomeric trough to the frame 29.

Figures 2, 3, 6:
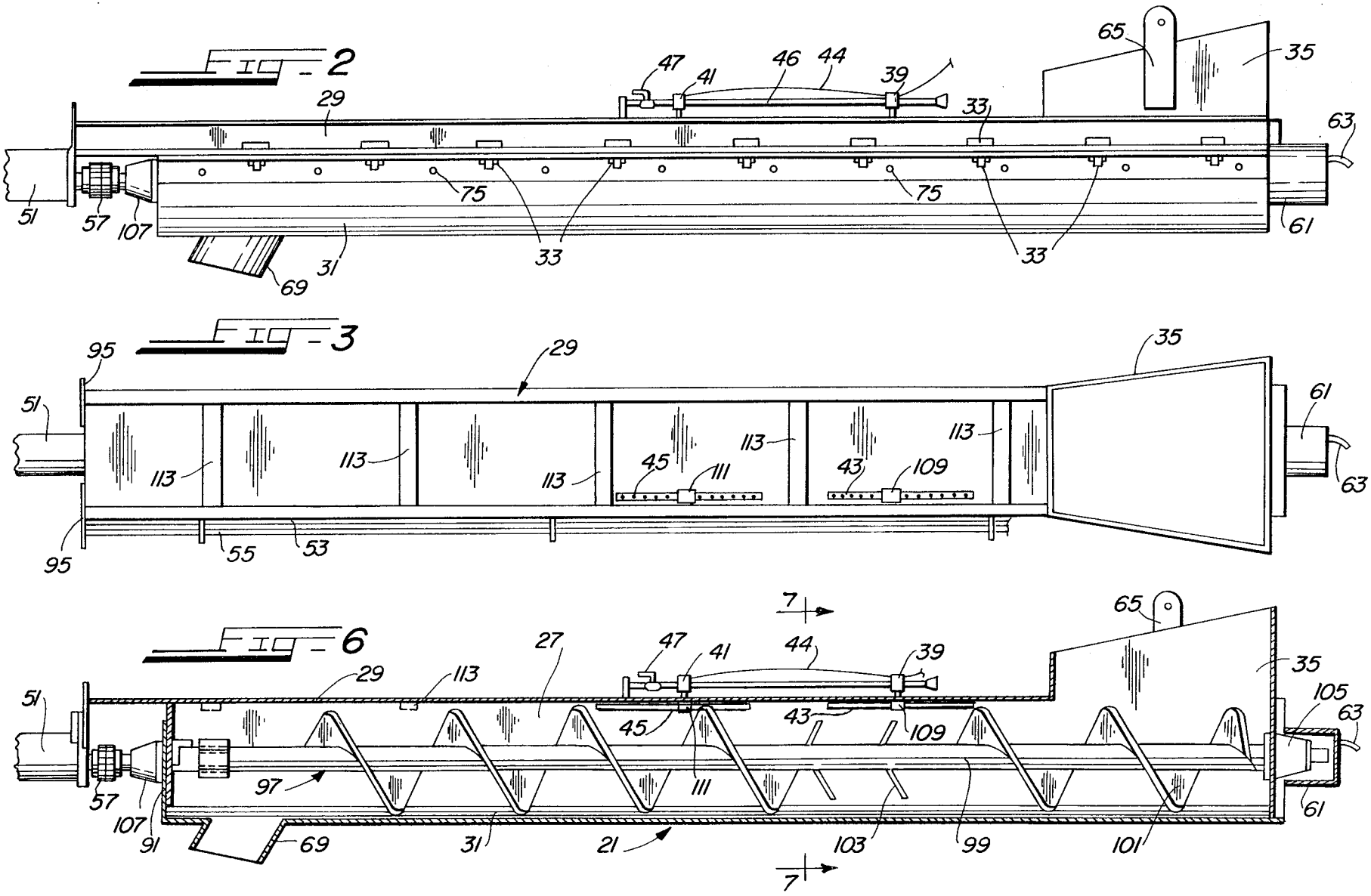
FIG. 2 is a side elevational view of the mixing apparatus of FIG. 1.
FIG. 3 is a bottom plan view of the top frame of the mixing apparatus of FIG. 2.
FIG. 6 is a cross-sectional view taken along line 6—6 of FIG. 4.

FIG. 6 shows a mixing auger 97 located in the mixing chamber 27. Auger 97 has a central shaft 99 and a spiral blade 101. Mixing paddles 103 are also located on the auger shaft 99.

The end of shaft 91 adjacent the inlet is supported in a bearing 105, which is enclosed in the bearing housing 61. At the other end, shaft 99 is supported in a bearing 107, which is located in the removable mounting plate 91. It may be seen that the removable mounting plate 91 separates the bearing 107, the flexible coupling 57 and the drive motor 51 from the mixing chamber 27. Thus, the cementitious material is not brought into contact with these elements, which helps to preclude problems arising from the cementitious material contaminating the motor or the bearing.

The liquid spraying elements 43 and 45 have the liquid passing through valves 39 and 41 conveyed into the two arms thereof through appropriate T-shaped members 109 and 111. As seen from this view, and also the view of FIG. 3 looking up at the inside top surface of the frame 29, the T-shaped members 109 and 111, with the associated spraying elements 43 and 45, are mounted on this inside top surface of the frame 29. The top of frame 29 has supporting channels 113, and the spraying elements 43 and 45 are located between adjacent ones of the channel members 113.

Figures 10, 11, 12, 13, 14:
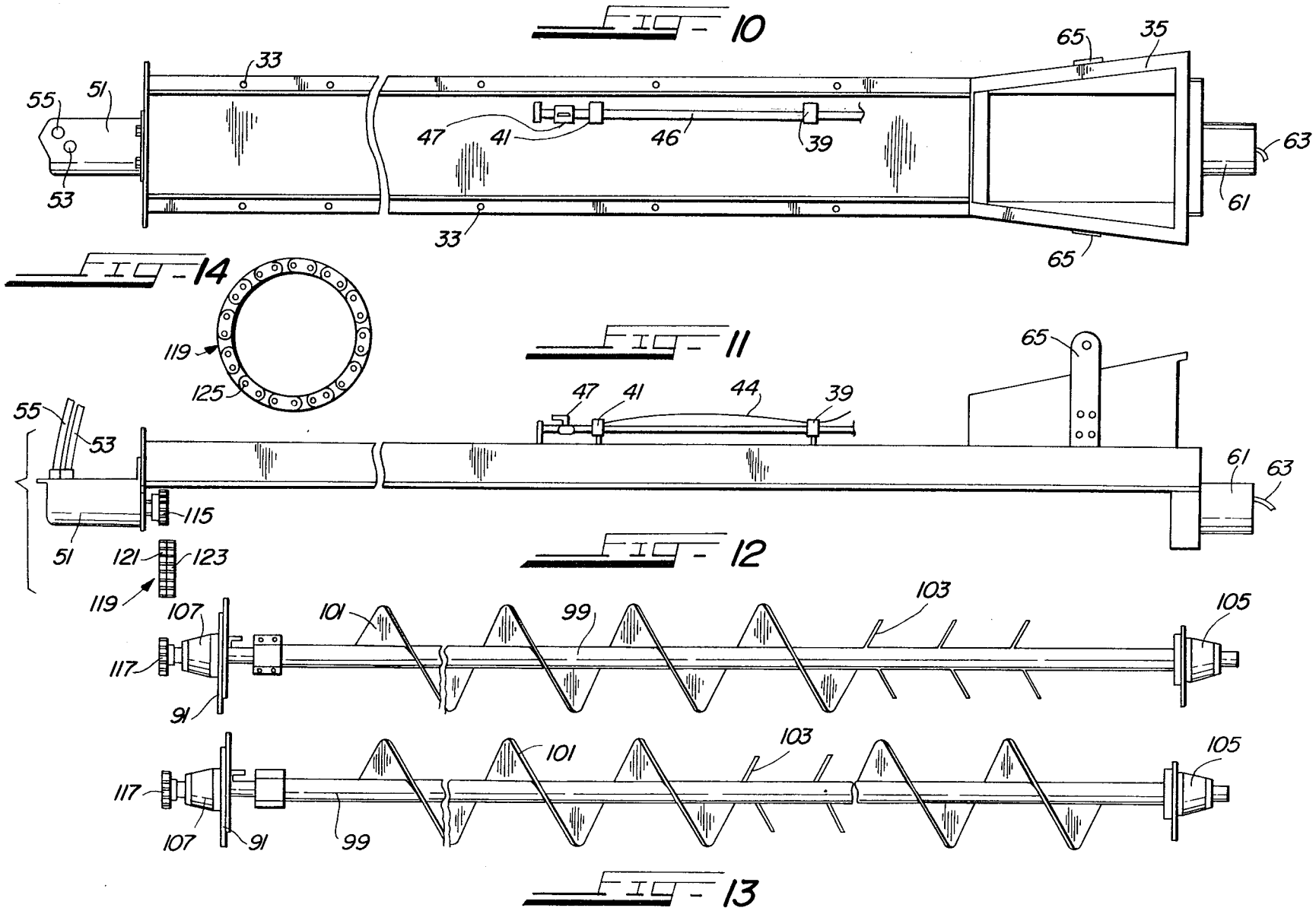
FIG. 10 is a top plan view of the mixing apparatus of FIG. 2.
FIG. 11 is a side elevational view of the top frame of FIG. 3.
FIG. 12 is a side elevational view of the auger utilized in the mixing apparatus of FIG. 2.
FIG. 13 is a side elevational view of the auger of FIG. 12 illustrating a rotational advancement of the auger.
FIG. 14 is a side elevational view of the releasable member of the flexible coupling of FIG. 11.

With reference to FIGS. 11, 12 and 14, the particular flexible coupling utilized in this preferred embodiment may be seen. The flexible coupling includes a toothed wheel 115 on the end of the motor shaft and a similar toothed wheel 117 on the discharge end of auger shaft 99. A double chain 119 has a first section 121 to engage the toothed wheel 115 and a second section 123 to engage the toothed wheel 117. In order to release the flexible coupling, a pin 125 (FIG. 14) may be removed. When recoupling the auger shaft to the motor shaft, it is only necessary to replace the pin 125 with the double chain placed around the toothed wheels 115 and 117.

It should be understood that various modifications, changes and variations may be made in the arrangement, operation and details of construction of the elements disclosed herein without departing from the spirit and scope of this invention.

I claim:

1. Apparatus mounted on a vehicle for mixing a cementitious material in which a volatile liquid is employed comprising:

an enclosed mixing chamber sealed to prevent the escape of the volatile liquid and any potentially dangerous fumes;

a solid frame forming the top of said mixing chamber and having an inlet end thereof pivotably mounted on the vehicle;

an easily removable elastomeric trough forming the bottom of said mixing chamber, the elastomeric material selected to be compatible with the materials being mixed;

an auger having a central shaft and mounted in said frame to convey materials through said mixing chamber;

mixing paddles mounted on the shaft of said auger;

a drive motor for said auger mounted on said frame;

a releasable flexible coupling between the aligned shafts of said motor and said auger to permit removal of said auger from said frame;

an inlet hopper to introduce substantially dry material into said mixing chamber;

liquid injection means to introduce a liquid into said mixing chamber at a distance removed from said inlet hopper to have said substantially dry material form a plug to prevent the liquid and any fumes from backing up said inlet hopper; and a discharge opening formed in said elastomeric trough.

2. Apparatus as claimed in claim 1 wherein:

said frame is an inverted substantially U-shaped member;

a horizontally extending flange is located along the bottom edge on each side of said U-shapaed member;

a horizontally extending flange is provided along the top edge on each side of said elastomeric trough; and rapidly disengageable connecting means releasably join said flanges of said frame and said elastomeric trough.

3. Apparatus as claimed in claim 2 wherein said connecting means comprises a plurality of slotted pins and wedges.

4. Apparatus as claimed in claim 1 wherein:

the shaft of said auger is mounted in a bearing at each end thereof;

said bearing at the discharge end of the apparatus is located in a plate member that is releasably mounted to said frame; and the shaft of said auger beyond said bearing at the discharge end of the apparatus is connected to said motor by said releasable flexible coupling.

5. Apparatus as claimed in claim 4 wherein said flexible coupling comprises:

a first toothed wheel at the end of the shaft of said auger;

a second toothed wheel at the end of the shaft from said motor; and a double chain to engage said toothed wheels, said chain being selectively separable to permit removal of said auger from said frame.

6. Apparatus as claimed in claim 1 wherein said liquid injection means comprises an arrangement to insert the liquid over a length of said auger to wash the auger and promote more complete mixing.

7. Apparatus as claimed in claim 6 wherein said liquid injection means comprises:

a pair of spray elements extending along a portion of said auger;

a pair of valves to determine the insertion of liquid into said spray elements; and control means to selectively activate said valves.

8. Apparatus as claimed in claim 1 wherein:

the shaft of said auger is mounted in a bearing at each end thereof; and said bearing at the inlet end of the apparatus is enclosed in a housing and a gas is introduced at relatively low pressure to prevent the liquid or any fumes from seeping into the bearing housing.

9. Apparatus as claimed in claim 1 wherein a compatible sealer is located in all joints to prevent leakage of fumes.

10. Apparatus mounted on a vehicle for mixing a quick-setting cementitious material in which a volatile liquid is employed comprising:

an enclosed mixing chamber sealed to prevent the escape of the volatile liquid and any potentially dangerous fumes;

an inverted substantially U-shaped solid frame forming the top of said mixing chamber and having an inlet end thereof pivotably mounted on a vehicle;

an auger having a central shaft and mounted in said frame to convey materials through said mixing chamber;

a first bearing adjacent the inlet end of said mixing chamber to rotatably support one end of the auger shaft, said first bearing being enclosed in a housing into which a low pressure gas is inserted to prevent seepage of the liquid or fumes into said first bearing;

a second bearing adjacent a discharge end of said mixing chamber to rotatably support the other end of the auger shaft, said second bearing located in a plate member that is releasably mounted on said frame;

a drive motor for said auger mounted on said frame adjacent the discharge end of said mixing chamber;

a releasable flexible coupling between the discharge end of the auger shaft aligned with the shaft of said drive motor to protect said motor and to permit removal of said auger from said mixing chamber;

a removable elastomeric trough forming the bottom of said mixing chamber, said elastomeric trough being replaceable to permit the mixing of different materials requiring troughs formed of different elastomeric materials to be compatible therewith;

mating horizontal flanges formed along the bottom edges of said frame and the top edge of said elastomeric trough;

a plurality of slotted pins and wedges to releasably join said flanges of said frame and said trough and permitting rapid disengagement of said frame and said trough after mixing;

an inlet hopper mounted on said frame to introduce substantially dry material into said mixing chamber;

a spray element mounted on the inner side of the top of said frame along a length of said auger to inject a liquid into said mixing chamber, said spray element being spaced from said inlet hopper so that the substantially dry material forms a plug to prevent the liquid and any fumes from backing up the inlet hopper;

valve means to determine the insertion of liquid into said spray element;

control means to selectively activate said valve means to introduce a proper amount of liquid into said mixing chamber; and a discharge opening formed in the bottom of said elastomeric trough.

11. Apparatus as claimed in claim 10 wherein the liquid is methyl methacrylate.

* * * * *